US009345295B2

(12) United States Patent
Li

(10) Patent No.: US 9,345,295 B2
(45) Date of Patent: May 24, 2016

(54) OUTDOOR UMBRELLA WITH BUILT-IN ELECTRO CONTROL PANEL

(75) Inventor: Wanda Ying Li, Irvine, CA (US)

(73) Assignee: Oliver Joen-An Ma, Arcadia, CA (US)

( * ) Notice: Subject to any disclaimer, the term of this patent is extended or adjusted under 35 U.S.C. 154(b) by 0 days.

(21) Appl. No.: 12/798,411

(22) Filed: Apr. 2, 2010

(65) Prior Publication Data

US 2010/0192999 A1 Aug. 5, 2010

Related U.S. Application Data

(63) Continuation-in-part of application No. 11/514,817, filed on Sep. 1, 2006.

(51) Int. Cl.

| | |
|---|---|
| ***A45B 3/02*** | (2006.01) |
| ***A45B 23/00*** | (2006.01) |
| *A45B 3/00* | (2006.01) |

(52) U.S. Cl.

CPC . *A45B 3/02* (2013.01); *A45B 23/00* (2013.01); *A45B 3/00* (2013.01); *A45B 2023/005* (2013.01); *A45B 2200/1027* (2013.01); *A45B 2200/1036* (2013.01)

(58) Field of Classification Search

USPC ..... 135/16, 20.1, 20.3, 21, 91, 910; 362/102

See application file for complete search history.

(56) References Cited

U.S. PATENT DOCUMENTS

| | | | | |
|---|---|---|---|---|
| 5,029,239 | A * | 7/1991 | Nesbit | 455/344 |
| 5,273,062 | A * | 12/1993 | Mozdzanowski | 135/16 |
| 6,598,990 | B2 * | 7/2003 | Li | 362/102 |
| 6,923,194 | B2 * | 8/2005 | Li | 135/21 |
| 7,331,684 | B2 * | 2/2008 | Tung | 362/102 |
| 7,648,339 | B1 * | 1/2010 | Ediger et al. | 416/142 |
| 2003/0192579 | A1 * | 10/2003 | Llamas Garijo | 135/16 |
| 2005/0133077 | A1 * | 6/2005 | Zerillo | 135/20.3 |
| 2005/0161067 | A1 * | 7/2005 | Hollins | 135/16 |

* cited by examiner

*Primary Examiner* — Noah Chandler Hawk

(74) *Attorney, Agent, or Firm* — Raymond Y. Chan; David and Raymond Patent Firm

(57) ABSTRACT

An outdoor umbrella for electrical appliances includes a supporting frame, an awning frame, and an electro-control panel. The awning frame includes a functional umbrella hub suspendedly supported by the supporting frame for supporting the electrical appliances in position, a plurality of awning frames radially and outwardly extended from the functional umbrella hub, and an awning supported by the awning arms to define a shading area under the awning. The electro-control panel includes a control circuitry and a control device. The control circuitry has an input terminal adapted for electrically connecting to a power source, and a plurality of control terminals for selectively connecting to the electrical appliances respectively. The control device is electrically connected to the control circuitry for selectively controlling each of the electrical appliances in an on-and-off manner.

8 Claims, 20 Drawing Sheets

OUTDOOR UMBRELLA WITH BUILT-IN ELECTRO CONTROL PANEL

CROSS REFERENCE OF RELATED APPLICATION

This is a Continuation-In-Part application that claims the benefit of priority under 35 U.S.C. §119 to a non-provisional application having an application Ser. No. 11/514,817 and a filing date of Sep. 1, 2006.

BACKGROUND OF THE PRESENT INVENTION

1. Field of Invention

The present invention relates to an umbrella, and more particularly to an outdoor umbrella with built-in electro-control panel which is capable of controlling at least one electrical appliance provided on the outdoor umbrella in an on-off manner.

2. Description of Related Arts

A conventional outdoor umbrella usually comprises a supporting frame, an awing frame movably supported on the supporting frame, and an awning fabric supported on the awning frame for proving shading in a shading area under the awing fabric. Conventionally, the outdoor umbrella is usually foldable so that when it is not in use, the outdoor umbrella can be folded into a compact size for convenient transport and storage.

People usually use the conventional outdoor umbrella for a wide variety of outdoor activities. For example, people may use the outdoor umbrella during camping for providing some sort of shielding from sunlight. Very often, when people are using the outdoor umbrella in outdoor environment, they need something more, apart from shading, to accomplish their intended activities. For instances, they require light during night time and they may need fans when the weather is too hot. As a result, they may bring their own light and fans to the intended activities and this may create great trouble to them.

Therefore, this is the main disadvantage to conventional outdoor umbrella in that a typical outdoor activity usually requires a wide range of electrical appliances, such as lighting devices, audio devices, or ventilating devices for providing extra support to the activities being held. Thus, users of the conventional outdoor umbrella usually need to bring their own electrical appliances and plan in advance as to how to securely locate those electrical appliances. For example, they have to plan in advance as to how to mount lighting devices onto the outdoor umbrella. They also have to consider how to get power to light up all the electrical appliances.

As a matter of fact, there exist some outdoor umbrellas which comprise some sorts of built-in electrical appliances such as lighting devices. However due to power availability, mounting limitation and ease of control, there are currently very few, if not no, comprehensive outdoor umbrella which is capable of providing electrical appliances other than lighting devices. In worse situations, one may need to prepare a lot of batteries for powering up all of the electrical appliances.

Another problem, however, may exist. Since the outdoors umbrellas have to support many electrical appliances with proper electrical connection, it becomes more difficult for the usual folding or unfolding mechanisms to operate. In short, the electrical appliances may actually affect the operation of the outdoor umbrellas so as to defeat the very purpose of having those outdoor umbrellas.

Furthermore, even if one incorporates a wide variety of electrical appliances onto the outdoor umbrella, and manages to acquire the necessary power, one may face control problem for these electrical appliances, in that different electrical appliances may require different control switches and electrical connections. As a result, the user of the present may feel that it is difficult and inconvenient to comprehensively control all the electrical appliances of the outdoor umbrella.

SUMMARY OF THE PRESENT INVENTION

An object of the present invention is to provide an outdoor umbrella with a built-in electro-control panel, wherein a control panel of the electro-control panel is affixed at the awning frame, so as to minimize the distance between the control panel and each of the electrical appliances.

Another object of the present invention is to provide an outdoor umbrella with a built-in electro-control panel, wherein no pre-wiring of an extending cable hidden within a hollow supporting frame is required for electrically connecting the control panel to each of the electrical appliances, so as to simplify the wire connecting arrangement therebetween.

Another object of the present invention is to provide an outdoor umbrella which comprises a built-in electro-control panel, which is capable of providing one-stop comprehensive control to a wide variety of electrical appliances installed onto the outdoor umbrella in an on-off manner, so as to minimize the hassle of separately controlling the electrical appliances by different controllers.

Another object of the present invention is to provide an outdoor umbrella which comprises a built-in electro-control panel, which is capable of optimally coordinating a plurality of electrical appliances on the outdoor umbrella so as to optimally and comprehensively controlling the operation thereof.

Another object of the present invention is to provide an outdoor umbrella comprising a built-in electro-control panel, which is capable of fitting into a wide variety of outdoor umbrella adopting different sources of electrical power.

Another object of the present invention is to provide an outdoor umbrella which comprises a built-in electro-control panel which does not affect the normal operation of the outdoor umbrella so as to facilitate a widespread application of the present invention.

Accordingly, in order to accomplish the above objects, the present invention provides an outdoor umbrella for electrical appliances, comprising:

a supporting frame, which comprises a supporting shaft having an upper portion;

an awning frame, which comprises a functional umbrella hub suspendedly supported by the supporting frame for supporting the electrical appliances in position, a plurality of awning frames radially and outwardly extended from the functional umbrella hub, and an awning supported by the awning arms to define a shading area under the awning, wherein the upper portion of the supporting frame is coupled with the awning frame; and a control panel of the electro-control panel, which is supported at the awning frame that the control panel is located at a position adjacent to the electrical appliances, comprising:

a control circuitry having an input terminal adapted for electrically connecting to a power source, and a plurality of control terminals for selectively connecting to the electrical appliances respectively; and a control device electrically connecting to the control circuitry for selectively and adjustably controlling each of the electrical appliances.

These and other objectives, features, and advantages of the present invention will become apparent from the following detailed description, the accompanying drawings, and the appended claims.

DETAILED DESCRIPTION OF THE PREFERRED EMBODIMENT

Figure 1:
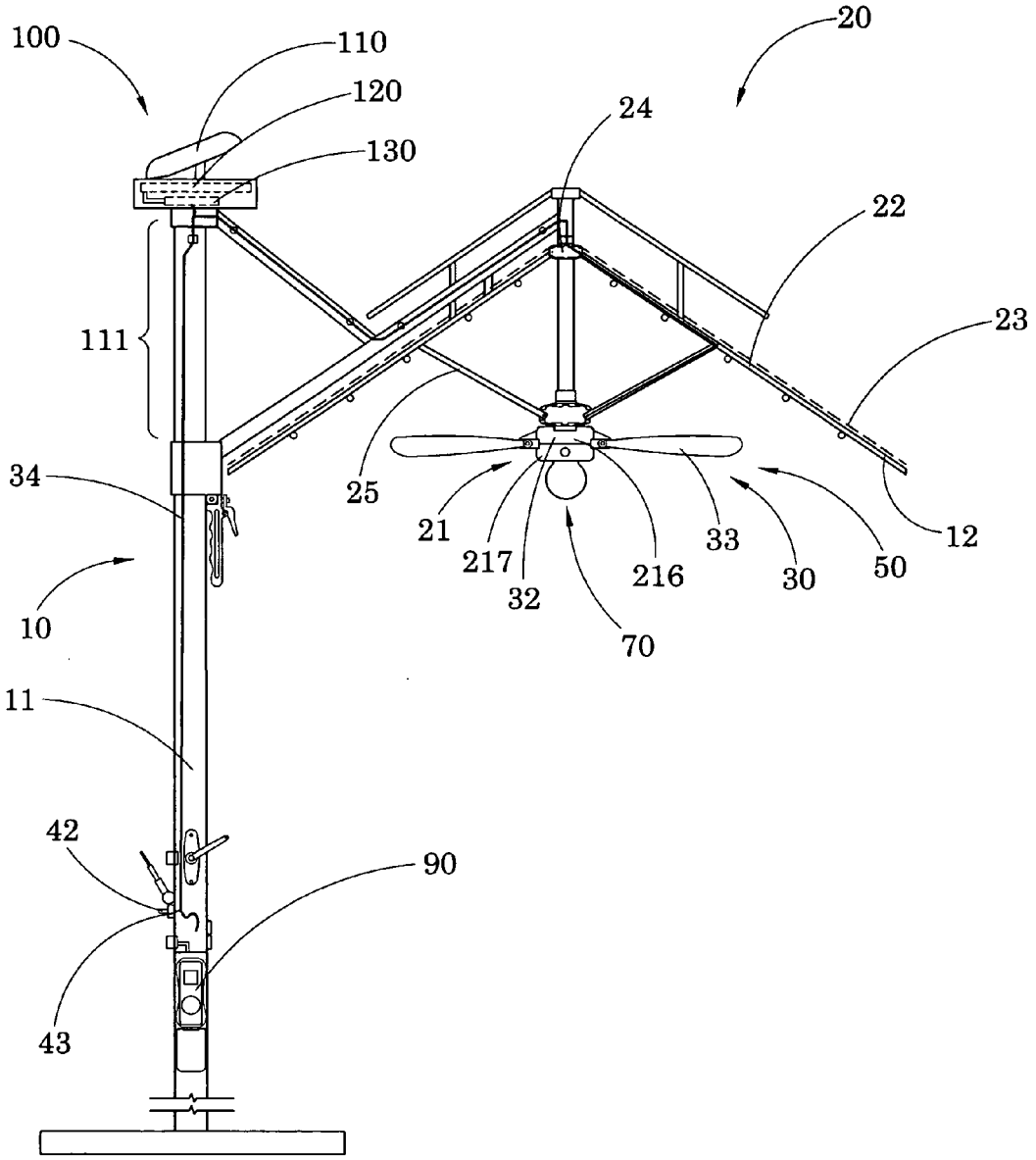
FIG. 1 is a perspective view of an outdoor umbrella according to a preferred embodiment of the present invention.

Referring to FIG. 1 to FIG. 4, and FIG. 6 and FIG. 7 of the drawings, an outdoor umbrella according to a preferred embodiment of the present invention is illustrated, in which the outdoor umbrella comprises a supporting frame 10, an awning frame 20, a ventilation arrangement 30, and a connector head 60.

The awning frame 20 comprises a functional umbrella hub 21 suspendedly supported by the supporting frame 10, a plurality of awning arms 22 radially and outwardly extended from the functional umbrella hub 21, and an awning 23 supported by the awning arms 22 to define a shading area under the awning 23.

The functional umbrella hub 21 further comprises a functional appliance for electrically connecting with the connector head 60, wherein the functional appliance comprises is embodied as a wide range of electrical appliances adapted for being installed onto the outdoor umbrella, such as the ventilation arrangement 30.

The ventilation arrangement 30 comprises a ventilation power unit 31 supporting at the functional hub 21, a driving rotor 32 rotatably and coaxially mounted at an outer wall of the functional umbrella hub 21 to electrically couple with the ventilation power unit 31, and a plurality of fan blades 33.

The plurality of fan blades 33 is spacedly mounted to the driving rotor 32 such that when the driving rotor 32 is driven to rotate, the fan blades 33 are swinging for creating airflow under the awning arms 12 within the shading area, so as to provide a ventilating effect as an additional function for the outdoor umbrella.

According to the above preferred embodiment of the present invention, the umbrella frame 10 comprises a hollow supporting shaft 11 adapted for securely standing on a ground surface for suspendedly supporting the awning frame 20 and the ventilation arrangement 30. On the other hand, the awning frame 20 further comprises an upper housing 24 suspendedly supported by the hollow supporting shaft 11, in which the awning frame 20 is radially extended from the upper housing 24 for moving between a folded position and an unfolded position. When the awning frame 20 is in the folded position, the awning frame is pivotally folded towards each other to form a compact structure of the outdoor umbrella, and when the awning frame 20 is in the unfolded position, the awning frame 20 is radially, outwardly and pivotally extended to shade sunlight in the shading area defined by the awning 23.

Moreover, the awning frame 20 further comprises a plurality of awning supporting member 25 each of which is movably extended from the functional umbrella hub 21 to the respective awning arms 22 for movably supporting the awning frame 20 to move between the folded position and the unfolded position.

In order to control an operation of the ventilation arrangement 30, the outdoor umbrella further comprises a control panel 40 supported at the supporting frame 10 to electrically control the ventilation arrangement 30, wherein the control panel 40 comprises a control switch 41 operatively connected to the ventilation power unit 31 to adjustably control the operation parameters, such as rotational speed, of the driving rotor 32 so as to control the operation of the driving rotor 32 for generating an optimal airflow of the outdoor umbrella.

Thus, the hollow supporting shaft 11 of the supporting frame 10 has an upper portion 111 coupling with the awning frame 20, wherein the ventilation arrangement 30 further comprises an extending cable 34 electrically extending from the control panel 40 to the ventilation power unit 31 through the supporting shaft 11 so as to conceal the extending cable 34 in a hidden manner. As a result, the extending cable 34 is physically protected and aesthetically hidden by the hollow supporting shaft 11 so as to maintain the maximum lift span and optimal aesthetic appearance of the present invention.

Figure 2:
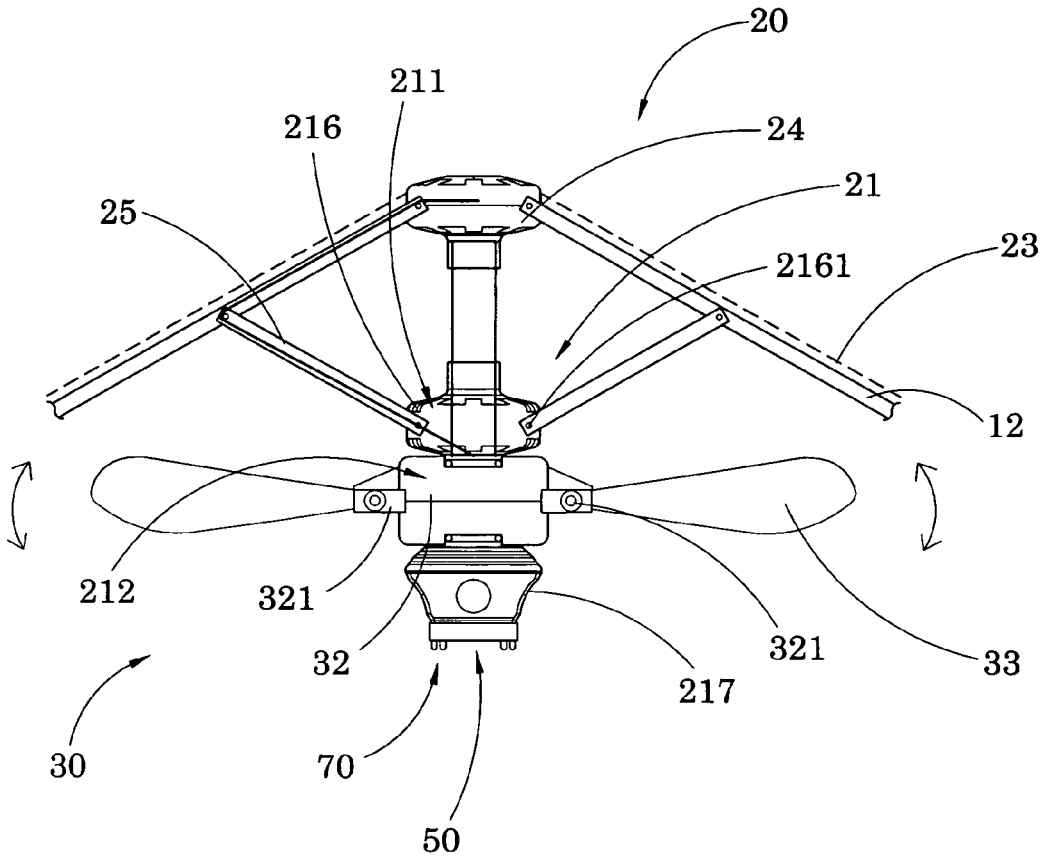
FIG. 2 is a schematic diagram of the outdoor umbrella according to the above preferred embodiment of the present invention.
Figure 3:
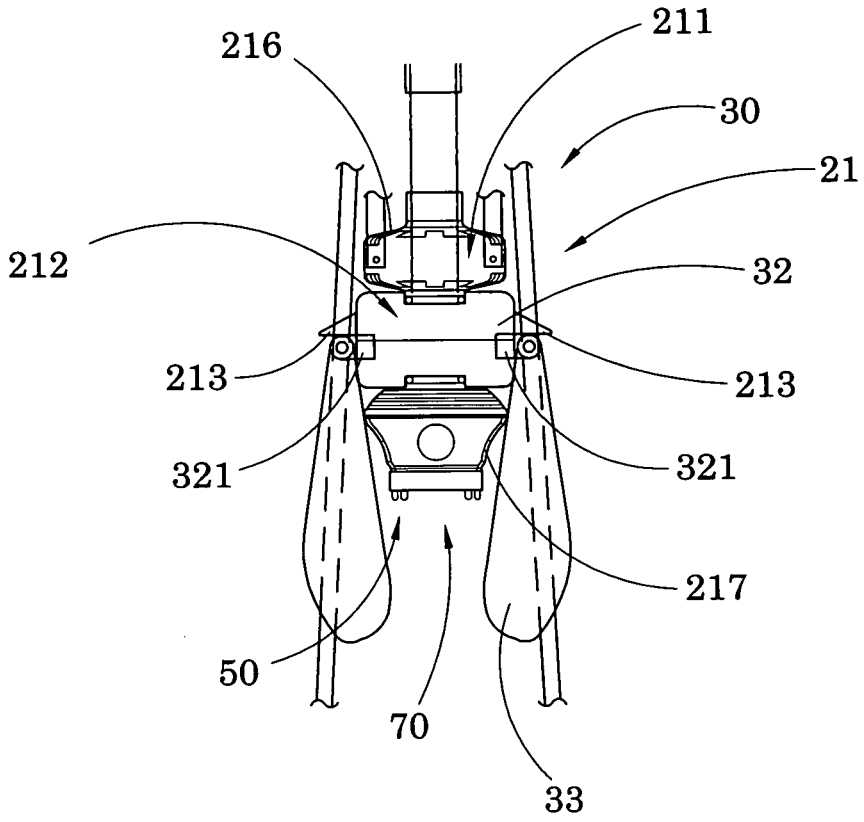
FIG. 3 is a schematic diagram of the ventilation arrangement according to the above preferred embodiment of the present invention.

Referring to FIG. 2 to FIG. 3 of the drawings, each of the fan blades 33 is made of soft fabric material so that when the driving rotor 32 is in an idle position, the fan blades are suspended at the functional umbrella hub 21, and when the driving rotor 32 is in an operative rotating position, the fan blades 31 are swinging by means of centrifugation force for creating the ventilating effect in the shading area. Thus, one may appreciate that since the fan blades 33 are made of soft fabric materials, they do not interfere with the normal operation of the outdoor umbrella because their shape is changeable for fitting the folding and unfolding operation of the outdoor umbrella.

In order to effectively and efficiently create adequate degree of airflow within the shading area, the driving rotor 32 further comprises a plurality of angled blade hinges 321 securely attaching inner ends of the fan blades 33 respectively at a predetermined angle, such that when the driving rotor 32 is driven to rotate, the fan blades 33 are inclinedly swinging with respect to the driving rotor 32 so as to create an effective and efficient airflow within the shading area.

The ventilation power unit 31 comprises a ring-shaped induction coil 311 supported in the functional umbrella hub 21 to coaxially align with the driving rotor 32 so as to drive the driving rotor 32 to rotate by induction.

The control panel 40 further comprises a temperature sensor 42 supported by the supporting frame 10 for detecting an ambient temperature and a sensor circuit 43 which is electrically communicating with the temperature sensor 42 and is arranged in such a manner that when the ambient temperature is higher than a user-preset temperature, the sensor circuit 43 automatically activates the ventilation power unit 31 to drive the driving rotor 32 to rotate to create the airflow in the shading area. In other words, the ventilation arrangement 30 can either be activated manually through the control panel 40, or by ambient temperature rising above a predetermined threshold. In the latter case, the ventilation arrangement 30 is activated automatically by the sensor circuit 43.

Furthermore, the control panel 40 further comprises a circuit transformer 44 electrically connecting with the ventilation arrangement 30 for transforming an AC power from an external power source to a DC power for the ventilation power unit 31. Thus, the ventilation arrangement 30 is adapted for being powered up by an external power source for prolonged use of the ventilation system. Alternatively, the ventilation arrangement 30 can also be powered by rechargeable batteries for shorter usage duration.

As a further alternative, the outdoor umbrella can further comprise a solar energy power system 100 which comprises a solar energy collection board 110 and a solar energy conversion circuit 120 mounted on the supporting frame 10. The solar energy collection board 110 is adapted to collect solar energy from sunlight, wherein the sunlight will be transformed to electric energy by the solar energy conversion circuit 120 for providing adequate power to operate the electrical appliances installed on the outdoor umbrella. The transformed energy is to be stored by a rechargeable battery 130 electrically connected with the solar energy conversion circuit 120.

In order to securely mount the ventilation arrangement 30 onto the supporting frame 10 and the awning frame 20, the functional umbrella hub 21 of the awning frame 20 has an upper portion 211 coupling with the awning arms 22 via the awning supporting members 25, a lower portion 212 receiving the ventilation power unit 31 therein, and a rotor seat 213 provided at an outer wall of the lower portion 212 to retain the driving rotor 32 in a rotatably movable manner.

Apart from the ventilation system, the outdoor umbrella according to the preferred embodiment is meant to accommodate a wide range of other electrical appliances so as to provide a wide range of accessory functions to outdoor activities.

Figure 6:
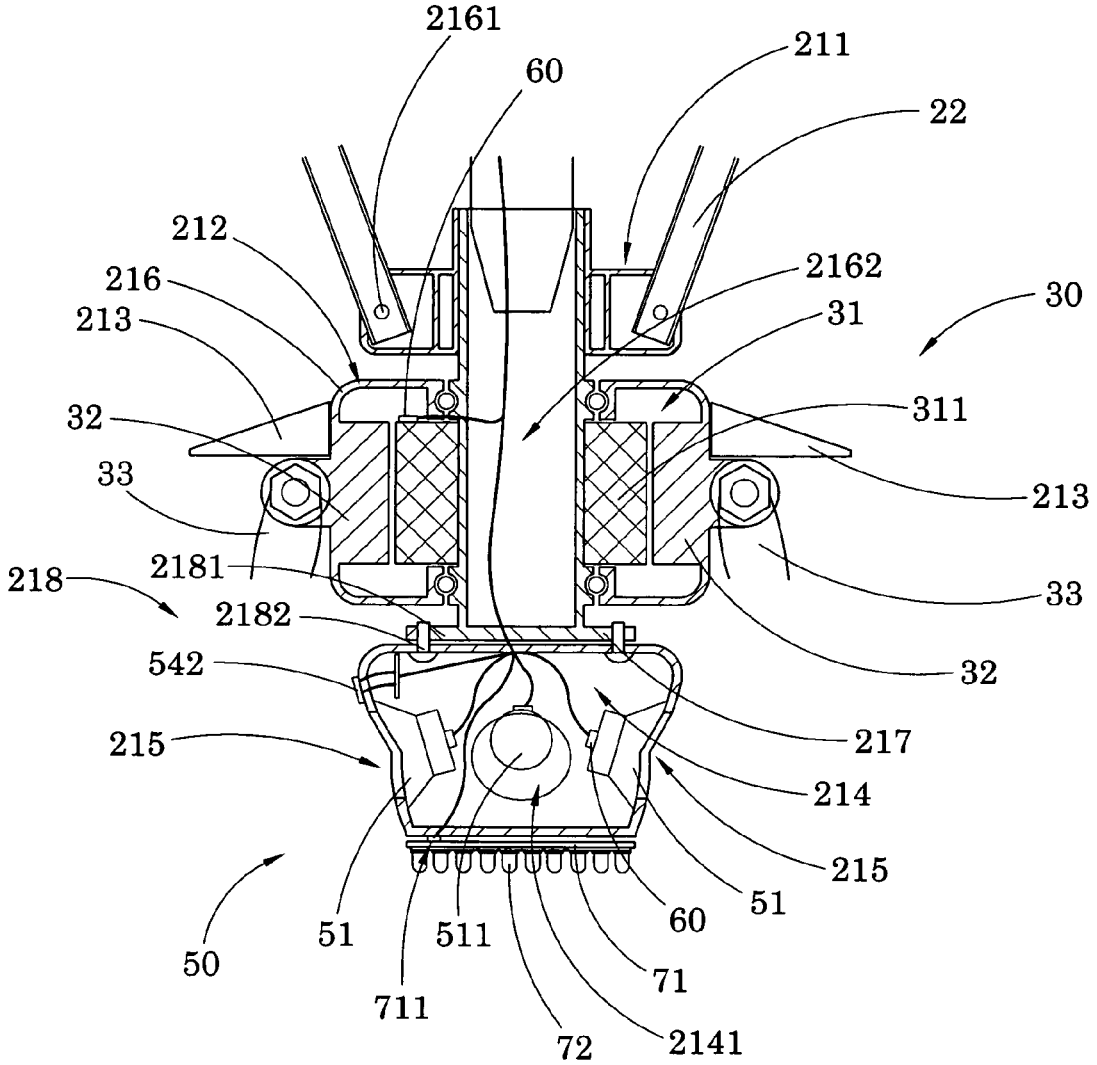
FIG. 6 is a sectional side view of the functional umbrella hub according to the above preferred embodiment of the present invention.

According to the preferred embodiment of the present invention, the functional umbrella hub 21 further has a speaker compartment 214 and at least one audio outlet 215, whereas the outdoor umbrella further comprises an audio system 50, as a built-in sound system, comprising a speaker unit 51 supported within the speaker compartment 214 of the functional umbrella hub 21 to align with the audio outlet 215, wherein when the audio signal is input at the control panel 40 via the audio outlet, the audio signal is transmitted to the speaker unit 51 for generating an audio sound as an additional function for the outdoor umbrella, as shown in FIG. 6 of the drawings.

The control panel 40 further comprises an auxiliary input 45 for communicatively connecting to a portable music player 90 to receive the audio signal therefrom, such that the control panel 40 transmits the audio signal to the speaker unit 51 for music broadcasting. The audio system 50 of the present invention is adapted to play music originated from a wide variety of conventional portable music players 90, such as CD players, DVD players, MP3 and the like for providing the maximum number of audio options for the user of the present invention.

The audio system 50 further comprises a sealing holder 52 mounted at the supporting frame 10 at a position adjacent to the control panel 40 for holding the portable music player 90 in the sealing holder 52 in a waterproof enclosing manner. Thus, the portable music player 90 is substantially protected from adverse environment factors and weather condition.

Figure 4:
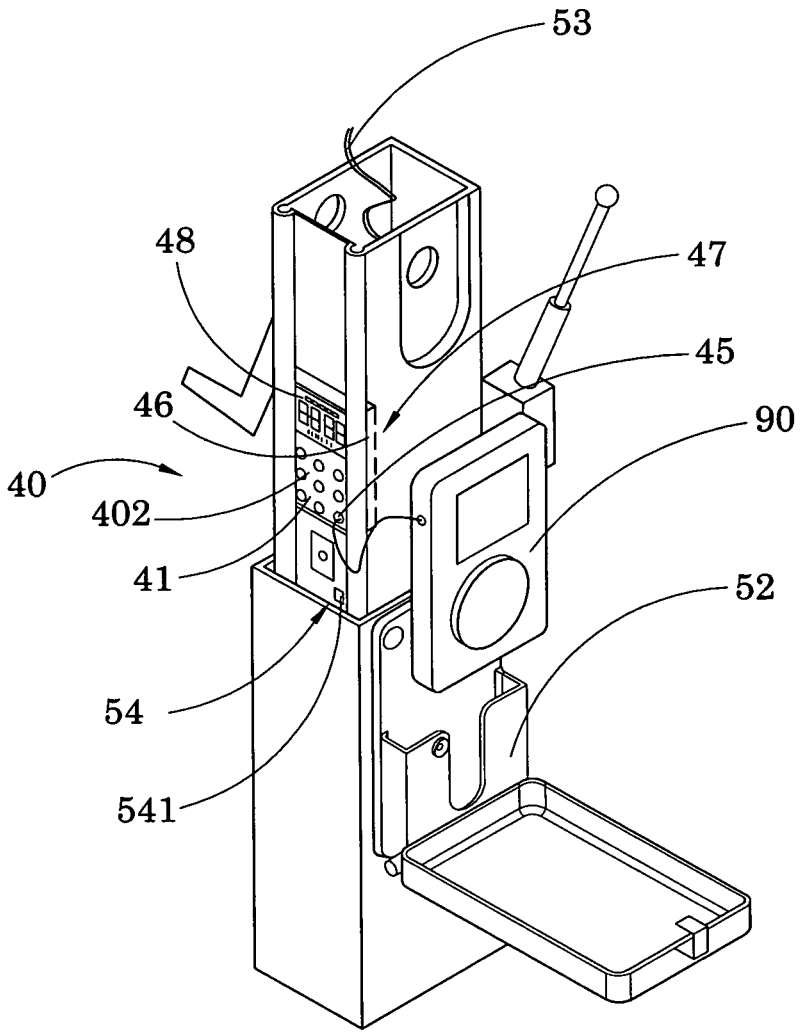
FIG. 4 is a perspective view of the control panel according to the above preferred embodiment of the present invention.

Referring to FIG. 4 of the drawings, in order to further enhance the source by which audio sound signal can be acquired, the control panel 40 further comprises a radio broadcasting circuit 46 for receiving radio wave as the audio signal, such that the control panel 40 transmits the audio signal to the speaker unit 51 for radio broadcasting. As such, the audio system 50 is also capable of processing radio signal for delivering radio sound signal as the audio signal as mentioned above.

The audio system 50 further comprises an audio transmitting cable 53 extending from the control panel 40 to the speaker 51 through the hollow supporting shaft 11 so as to transmit the audio signal from the control panel 40 to the speaker unit 51 via the audio transmitting cable 53 securely received in the hollow supporting shaft 11.

Alternatively, the audio system 50 further comprises a wireless transmission link 54 for wirelessly transmitting the audio signal from the control panel 40 to the speaker unit 51, wherein the wireless transmission link 54 comprises a wireless transmitter 541 integrated with the control panel 40 and a wireless receiver 542 which is integrated with the speaker unit 51 and is wirelessly communicating with the wireless transmitter 541 to wirelessly transmit the audio signal from the control panel 40 to the speaker unit 51. In this situation, the audio transmitting cable 53 may not be necessary, yet it can still be used in conjunction with the wireless transmission link 54 to cater for different needs.

Accordingly, the control panel 40 further comprises a control circuitry 47 operatively connecting to the speaker unit 51 of the audio system 50 to selectively operate and control the speaker unit 51, and a display screen 48 electrically connected to the control circuitry 47 for displaying an operation status thereof. As a result, the user is able to conveniently monitor the operation of the audio system 50 in a single display device, i.e. the display screen 48.

The speaker unit 51 comprises a plurality of speakers radially supported within the speaker compartment 214 of the awning frame 20 for creating a stereo surround sound effect when the audio signal is transmitted to the speaker unit 51.

In order to enhance the sound quality delivered by the audio system, the functional umbrella hub 21 further has a resonance chamber 2141 formed at the speaker compartment 214, wherein the speaker unit 51 further comprises a subwoofer speaker 511 supported at the resonance chamber 2141 for generating special sound quality of the audio sound output from the speaker unit 51, as shown in FIG. 6 of the drawings.

The functional umbrella hub 21 further comprises a hub body 216 having a plurality of hinges 2161 for respectively coupling with the awning arms 22 in a radially extending manner preferably via the awning supporting arms 25, and an interior cavity 2162 for the connector head 60 disposing therein.

More specifically, the functional umbrella hub 21 further comprises a functional hub 217, which is downwardly extended from the hub body 216 to communicate with the interior cavity 2162 thereof, having the speaker compartment 214 and the audio outlet 215, wherein the functional appliance is built-in with the functional hub 217 that the speaker is securely supported within the speaker compartment 214 at the audio outlet 215 such that the functional umbrella hub 21 is adapted for not only operatively incorporating with the outdoor umbrella via the hub body 216 but also providing the additional function for the outdoor umbrella via the functional hub 217 to enhance a practical use thereof.

Referring to FIG. 6 of the drawings, the functional appliance further comprises a light arrangement 70 provided at a bottom side of the functional hub 217 for electrically connecting with the connector head 60 so as to generate a light illumination as another additional function for the outdoor umbrella. More specifically, the light arrangement 70 comprises a ring-shaped light housing 71, having a connector inlet 711 for electrically connecting to the connector head 60, mounted to the bottom side of the functional hub 217, and a plurality of illumination elements 72 spacedly and coaxially mounted at the light housing 71 for illuminating an area under the awning arms 22, i.e. the shading area. Note that the illumination elements 72 are a plurality of LEDs electrically and spacedly mounted at the light housing 71.

The functional hub 217 is integrally extended from the hub body 216 to form a one-piece integral hub for allowing the connector head 60 extending into the functional hub 217 from the interior cavity 2162 of the hub body 216.

The functional umbrella hub 21 further comprises a mounting unit 218 for detachably mounting the functional hub 217 under the hub body 216, wherein the mounting unit 218 comprises a retaining panel 2181 integrally formed at the bottom side of the hub body 216, and at least a fastening element 2182 detachably fastening the functional hub 217 at the retaining panel 2181 to detachably mount the functional hub 217 to the hub body 216.

The light arrangement 70 may also comprise a ring-shaped light tube 73 mounted at the light housing 71 for illuminating an area under the awning arms 22. Thus, the light tube is capable of providing uniform line of light source for the shading area, a shown in FIG. 8C of the drawings.

Figure 7:
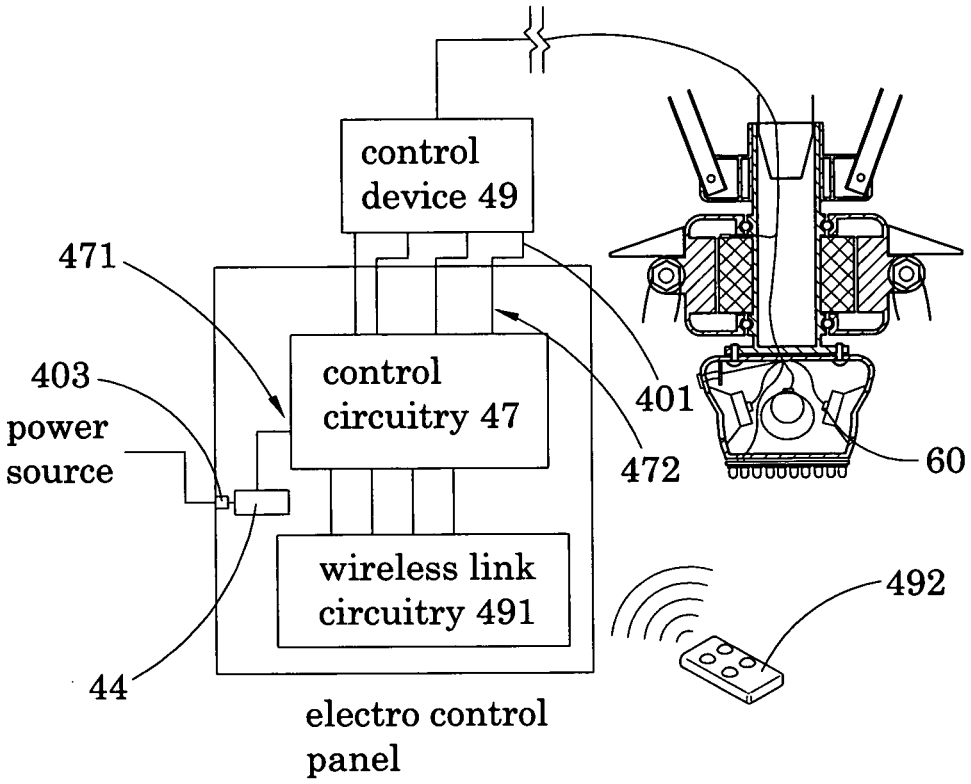
FIG. 7 is a schematic diagram of the electro-control panel according to the above preferred embodiment of the present invention.

Referring to FIG. 7 of the drawings, the control panel 40 is preferably embodied as an electro-control panel which is electrically controlled and operated for providing optimal control to the electrical appliances of the outdoor umbrella.

More specifically, the control panel 40 comprises the control circuitry 47 having an input terminal 471 adapted for electrically connecting to a power source, and a plurality of control terminals 472 for selectively connecting to the electrical appliances respectively. The control panel 40 further comprises a control device 49 electrically connecting to the control circuitry 47 for selectively controlling each of the electrical appliances in an on-and-off manner.

In order to connect with the functional umbrella hub 21, the control panel 40 as the electro-control panel further comprises a plurality of extending cables 401 electrically extending from the control terminals 472 respectively to the awning frame 20 through the hollow supporting shaft 11 in a prewiring manner.

Each of the extending cables 401 has the connector head 60 extended to the functional umbrella hub 21 through the hollow supporting shaft 11 for electrically connecting the corresponding electric appliance such that the outdoor umbrella is adapted for incorporating with the electric appliances as add on electric appliances, such as the ventilation arrangement 30, to provide additional functions of the outdoor umbrella when the corresponding electric appliance is mounted at the functional umbrella hub 21 and is electrically connected to the connector head 60.

Moreover, the electro-control panel further comprises a panel housing 402 built-in with the supporting frame 10 that the panel housing 402 is provided at a peripheral wall of the supporting frame 10 to protectively receive the control circuitry 47 in the panel housing 402. Thus, the user is able to control the electrical appliances by simply operating the control panel 40 at the panel housing 402.

Figure 5:
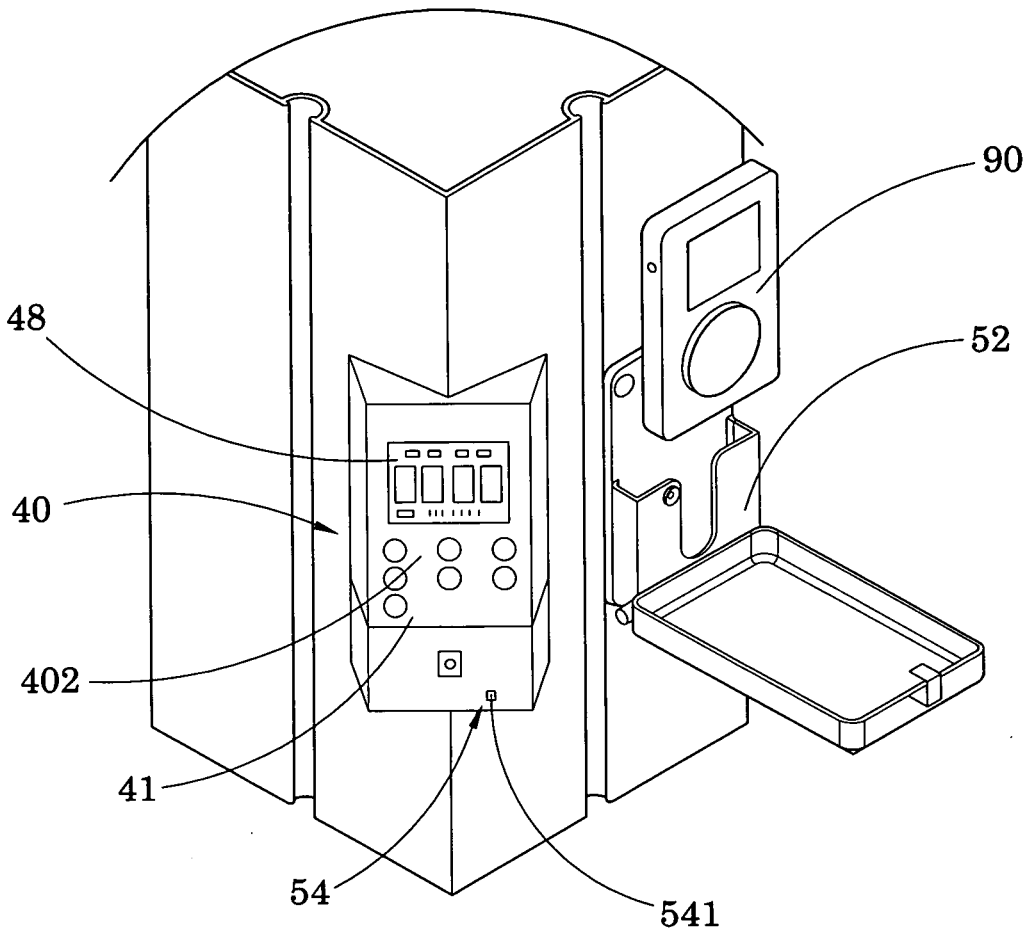
FIG. 5 is a slight alternative of the control panel according to the above preferred embodiment of the present invention.

It is worth mentioning that the panel housing 402 can be installed on the hollow supporting shaft 11 in different manner. For example, as shown in FIG. 4 of the drawings, the panel housing 402 can be installed at an outer peripheral surface of the hollow supporting shaft 11. Alternatively, as shown in FIG. 5 of the drawings, the panel housing 402 can be mounted at an outer corner portion of the hollow supporting shaft 11.

The control device 49 comprises the plurality of control switches 41 which are spacedly provided on the panel housing 402 and are electrically connected to the control terminals 472 of the control circuitry 47 respectively for manually controlling the corresponding electrical appliances in an on-and-off manner. Moreover, the display screen 48 is provided on the panel housing 402 and is electrically connected to the control circuitry 47 for displaying an operation status of each of the electrical appliances.

The control panel 40 as the electro-control panel further comprises an electric socket 403 which is provided on the supporting frame 10 and is electrically connected to the input terminal 471 for electrically connecting to a power source, such as an AC power source.

Accordingly, the circuit transformer 44 electrically connects the electric socket 403 with the input terminal 471 of the control circuitry 47 for transforming an AC power from the external AC power source to a DC power so as to supply a predetermined amount of electricity to the electric appliances.

The control circuitry 47 comprises the integrated radio broadcasting circuit 46 and the auxiliary input 45 for communicatively connecting to a portable music player 90, such that the control circuitry 47 provides an added audio function for incorporating with the electric appliances.

The control device 49 further comprises a wireless link circuitry 491 integrated with the control circuitry 47, and a remote control 492 wirelessly communicating to the wireless link circuitry 491 to control the control circuitry 47 for remotely controlling the electric appliances in a wireless manner.

Figure 8A:
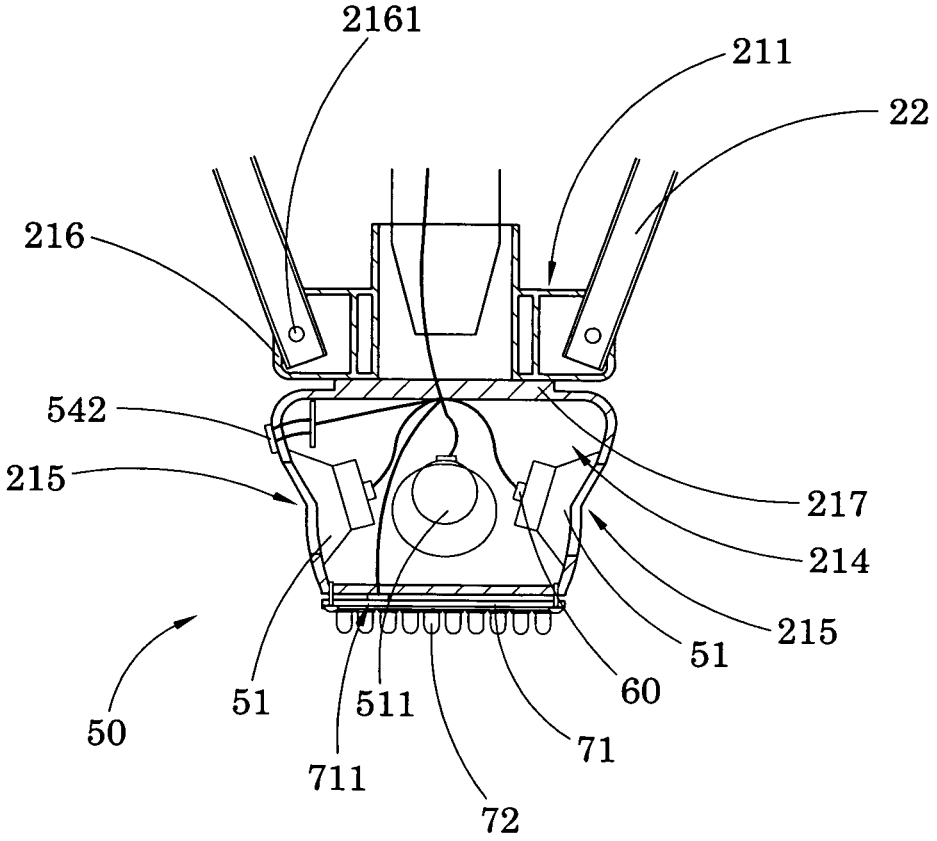
FIG. 8A to FIG. 8C are schematic diagrams of different combinations of electrical appliances according to the above preferred embodiment of the present invention.
Figure 8B:
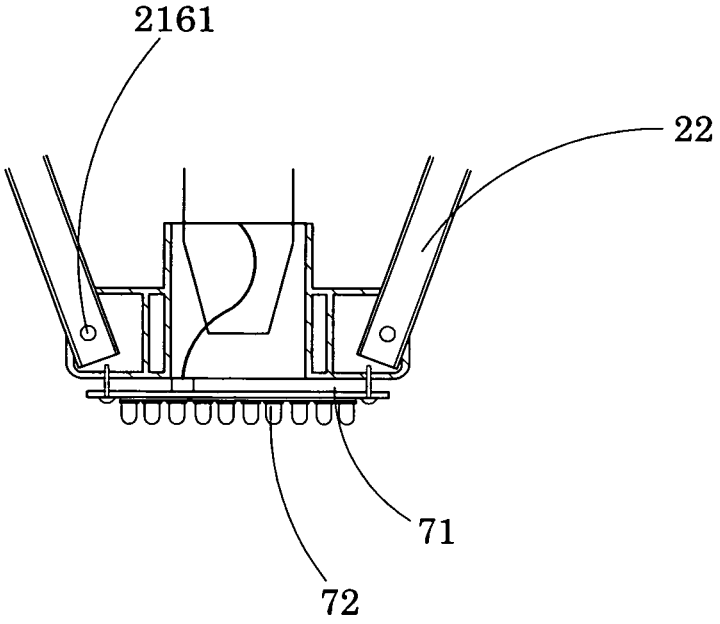
Figure 8C:
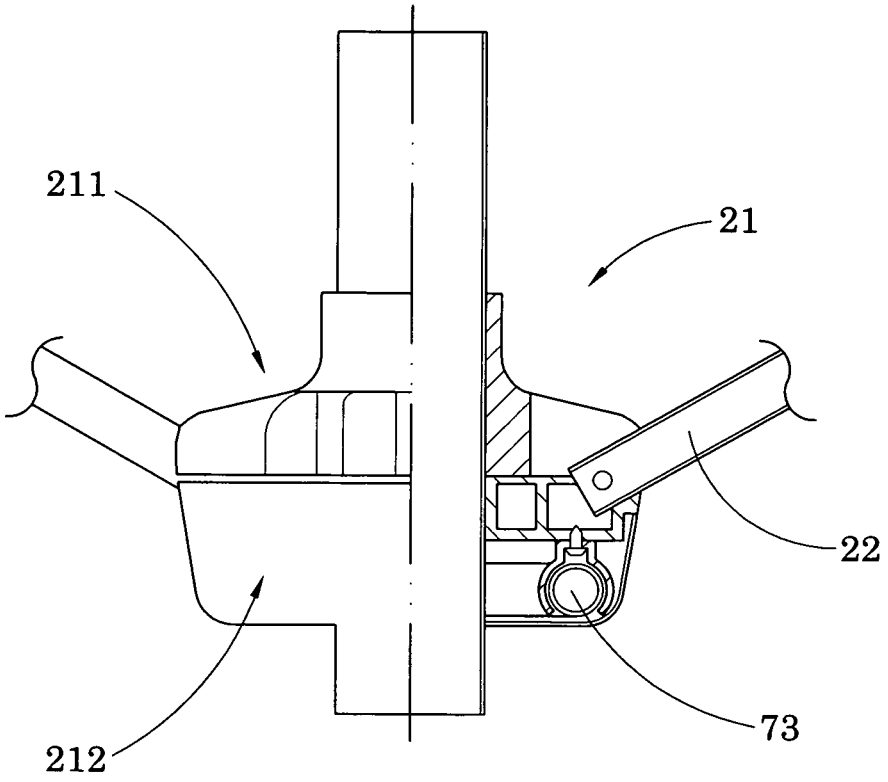

It is worth mentioning that the outdoor umbrella may form different embodiments with different combinations of electrical appliances. Referring to FIG. 8A of the drawings, the outdoor umbrella comprises the audio system 50, the light arrangement 70, but not the ventilation arrangement. Referring to FIG. 8B of the drawings, only the light arrangement 70 has been installed, and in FIG. 8C of the drawings, one may appreciate that the illumination elements 72 are embodied as the ring-shape light tube 73.

Figure 9:
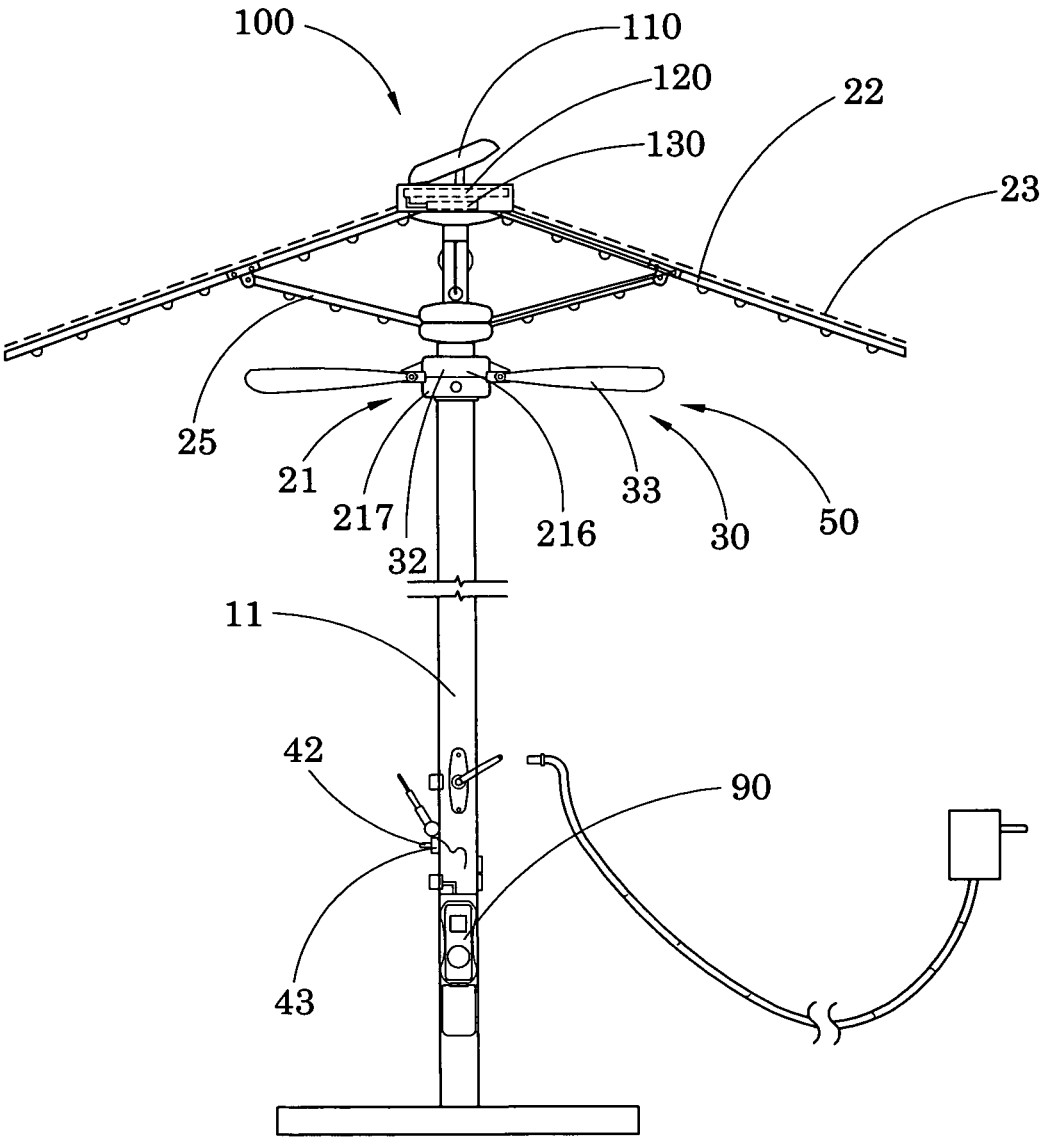
FIG. 9 is an alternative form of the supporting frame of the outdoor umbrella according to the above preferred embodiment of the present invention.

FIG. 9 illustrates a slight alternative of the outdoor umbrella in which awning frame 20 is movably coupled directly at the upper portion 111 of the hollow supporting shaft 11 for folding and unfolding, wherein the electrical appliances are mounted at the function umbrella hub 21 for performing the corresponding functions.

Figure 10A:
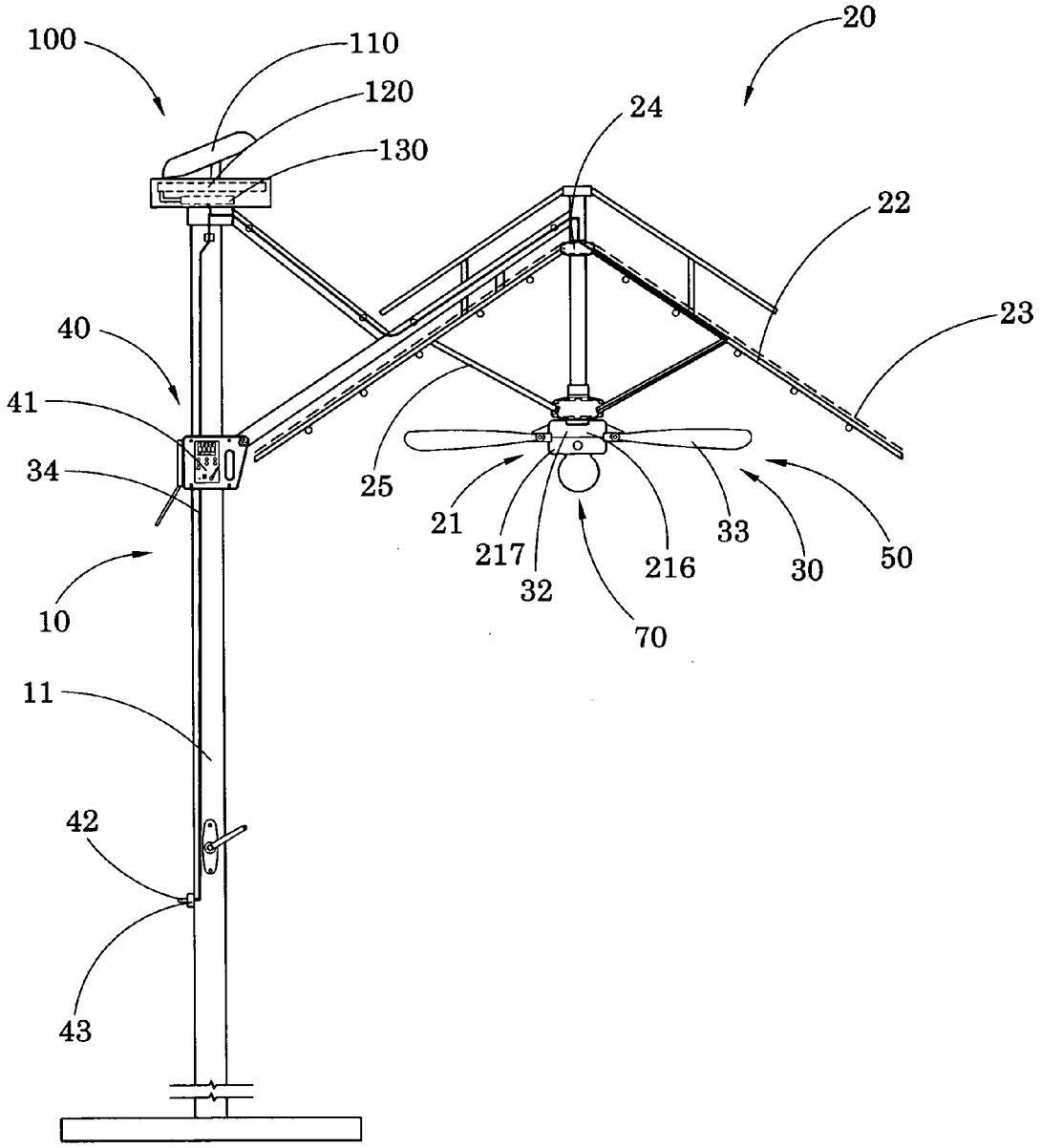
FIG. 10A and FIG. 10B are schematic diagrams of the outdoor umbrella according to the above preferred embodiment of the present invention, illustrating that the control panel can be mounted on different position.
Figure 10B:
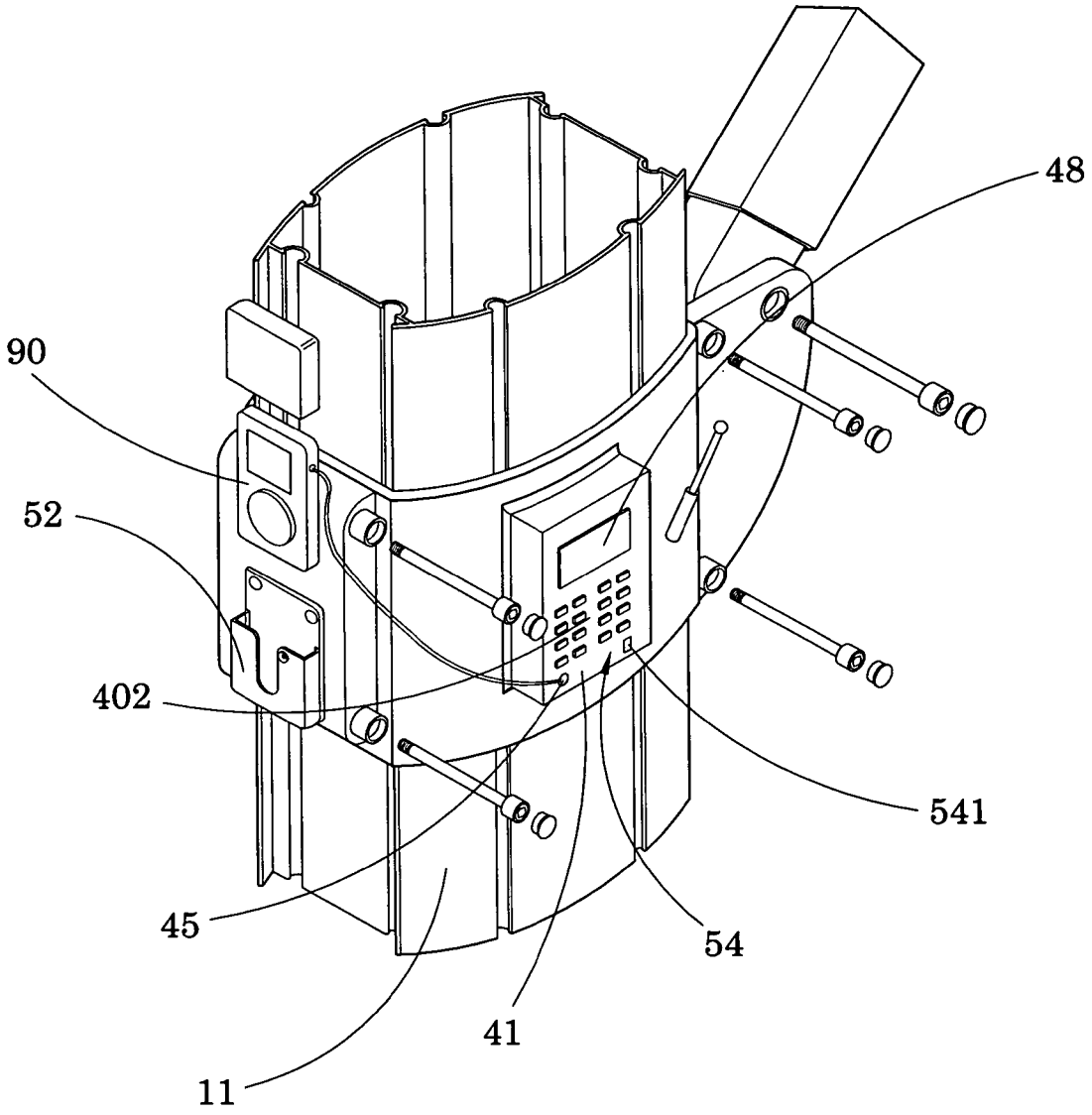

Referring to FIG. 10A and FIG. 10B of the drawings, the control panel 40 can also be mounted at an upper portion of the hollow supporting shaft 11 for controlling the different electrical appliances.

Referring to FIGS. 11 to 14 of the drawings, an outdoor umbrella according to a preferred embodiment of the present invention is illustrated, in which the outdoor umbrella comprises a supporting frame 10A, an awning frame 20A, one or more electrical appliances integrally formed at the outdoor umbrella, and an electro-control panel 40A electrically connected to each of the electric appliances for operatively controlling the electric appliances and a power source for supplying the electrical energy thereto.

The awning frame 20A comprises a functional umbrella hub 21A suspendedly supported by the supporting frame 10A, a plurality of awning arms 22A radially and outwardly extended from the functional umbrella hub 21A, and an awning 23A supported by the awning arms 22A to define a shading area under the awning 23A.

According to the above preferred embodiment of the present invention, the supporting frame 10A comprises a hollow supporting shaft 11A adapted for securely standing on a ground surface for suspendedly supporting the awning frame 20A and the ventilation arrangement 30A of the electrical appliance thereat. On the other hand, the awning frame 20A further comprises an upper housing 24A suspendedly supported by the hollow supporting shaft 11A, in which the awning frame 20A is radially extended from the upper housing 24A for moving between a folded position and an unfolded position. When the awning frame 20A is at the folded position, the awning arms 22A is pivotally folded towards each other to form a compact structure of the outdoor umbrella, and when the awning frame 20A is at the unfolded position, the awning arms 22A is radially, outwardly and pivotally extended to form the shading area under the awning 23A, so as for blocking the sunlight, rains, or the like. Accordingly, the hollow supporting shaft 11A of the supporting frame 10A further has an upper portion 111A for coupling with the awning frame 20A.

Moreover, the awning frame 20A further comprises a plurality of awning supporting member 25A each of which is movably extended from the functional umbrella hub 21A to the respective awning arms 22A for movably supporting the awning frame 20A to move between the folded position and the unfolded position.

Accordingly, the electrical appliances preferably comprise a ventilation arrangement 30A, au audio system 50A, and/or a light arrangement 70A, which may have similar structure as above first preferred embodiment. Therefore, the outdoor umbrella may only comprise one of the above electrical appliances, any two of the above electrical appliances, or all of the above electrical appliances at the same time. Other electrical appliances may be further provided for enhancing the functionality of the outdoor umbrella. For instances, a clock or an electrical heater of the electrical appliances may also be integrally formed at the outdoor umbrella as the add-on functional devices thereof.

As mentioned above, the ventilation arrangement 30A comprises a ventilation power unit 31A supporting at the functional umbrella hub 21A, a driving rotor 32A rotatably and coaxially mounted at an outer wall of the functional umbrella hub 21A to electrically couple with the ventilation power unit 31A, and a plurality of fan blades 33A.

The plurality of fan blades 33A is spacedly mounted to the driving rotor 32A such that when the driving rotor 32A is driven to rotate, the fan blades 33A are swinging for creating airflow under the awning arms 12A within the shading area, so as to provide a ventilating effect as an additional function for the outdoor umbrella. Therefore, the ventilation arrangement 30A is connected to the control panel 40A via connecting the power unit 31A with a control device 49A of the control panel 40A, so that the fan blades 33A being driven by the driving rotor 32A is able to be controllably operated via the control device 49A of the control panel 40A.

It is appreciated that the power unit 31A electrically connected to the control module 49A is able to adjustably control the operation parameters, such as a rotational speed of the driving rotor 32A, via the control module 49A of the control panel 40A, so as to control the operation of the driving rotor 32A for generating an optimal airflow of the outdoor umbrella.

Figure 12:
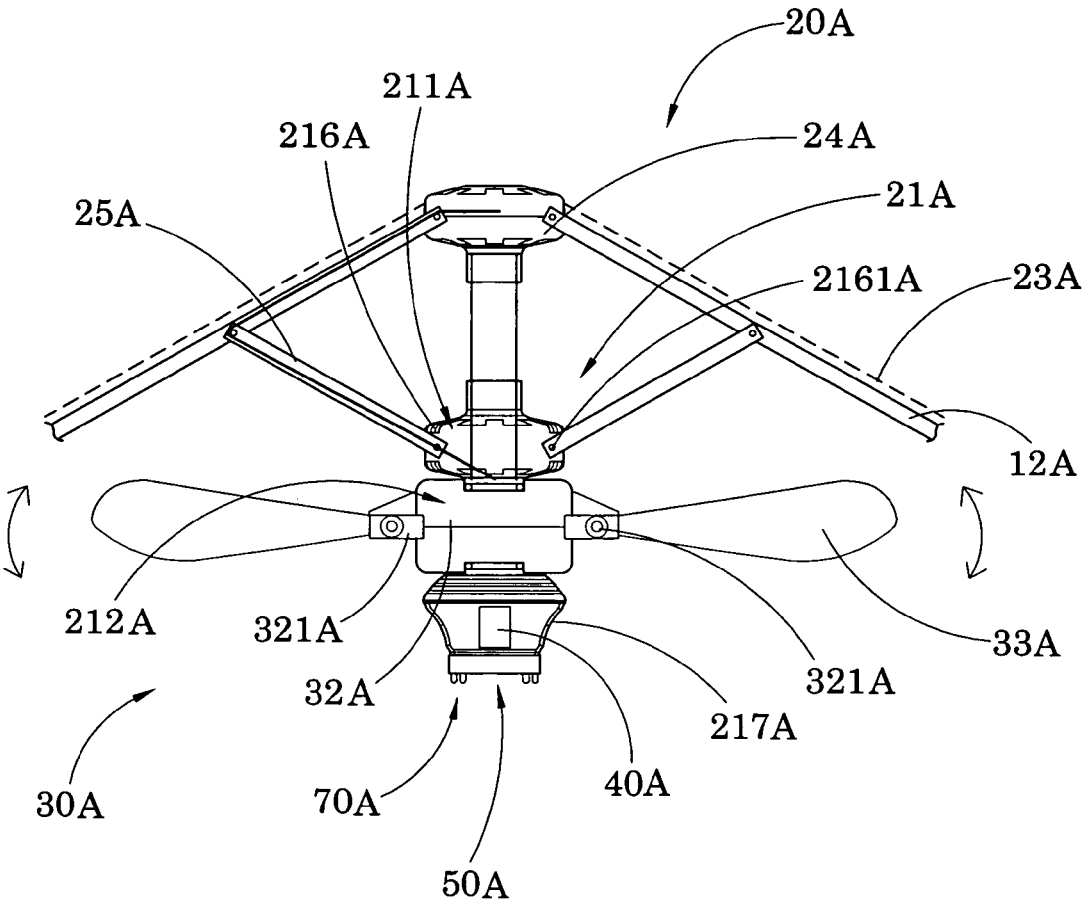
FIG. 12 is a schematic diagram of the outdoor umbrella according to the above second preferred embodiment of the present invention.

Referring to FIG. 12 of the drawings, each of the fan blades 33A is made of soft fabric material so that when the driving rotor 32A is in an idle position, the fan blades are suspended at the functional umbrella hub 21A, and when the driving rotor 32A is in an operative rotating position, the fan blades 31A are swinging by means of centrifugation force for creating the ventilating effect in the shading area. Thus, one may appreciate that since the fan blades 33A are made of soft fabric materials, they do not interfere with the normal operation of the outdoor umbrella because their shape is changeable for fitting the folding and unfolding operation of the outdoor umbrella.

In order to effectively and efficiently create adequate degree of airflow within the shading area, the driving rotor 32A further comprises a plurality of angled blade hinges 321A securely attaching inner ends of the fan blades 33A respectively at a predetermined angle, such that when the driving rotor 32A is driven to rotate, the fan blades 33A are inclinedly swinging with respect to the driving rotor 32A so as to create an effective and efficient airflow within the shading area.

The ventilation power unit 31A comprises a ring-shaped induction coil 311A supported in the functional umbrella hub 21A to coaxially align with the driving rotor 32A so as to drive the driving rotor 32A to rotate by induction.

In order to securely mount the ventilation arrangement 30A onto the supporting frame 10 and the awning frame 20A, the functional umbrella hub 21A of the awning frame 20 has an upper portion 211A coupling with the awning arms 22A via the awning supporting members 25A, a lower portion 212A receiving the ventilation power unit 31A therein, and a rotor seat 213A provided at an outer wall of the lower portion 212A to retain the driving rotor 32A in a rotatably movable manner.

Apart from the ventilation system, the outdoor umbrella according to the preferred embodiment is meant to accommodate a wide range of other electrical appliances so as to provide a wide range of accessory functions to outdoor activities.

According to the preferred embodiment of the present invention, the audio system 50A is preferably provided at the location within or adjacent to the functional umbrella hub 21A, wherein the audio system 50A preferably comprises a speaker unit 51A comprising one or more speakers. Therefore, the functional umbrella hub 21A further has a speaker compartment 214A and at least one audio outlet 215A, wherein the speaker unit 51A is supported within the speaker compartment 214A of the functional umbrella hub 21A to align with the audio outlet 215A, as a built-in sound system of the outdoor umbrella.

The audio system 50A further comprises an audio signal input module 511A for wirely or wirelessly receiving an audio signal, such as radio, portable music player, or the likes, and an audio signal output module 512A electrically linking to the speaker unit 51A for generating a sound effect in responsive to the audio signal. More specifically, the audio signal input module 511A is able to be built-in with the control panel 40A and electrically connected to audio signal output module 512A for transmitting the audio signal to the speaker unit 51A, so as to generate the sound effect as another add-on function or add-on electrical appliance of the outdoor umbrella.

A connector head 60A may be further provided at a position with the functional umbrella hub 21 for electrically connecting the control panel 40A with each of the electrical appliances respectively. The umbrella hub may further has a functional hub 217A integrally extended from a hub body 216A of the functional umbrella hub 21A to form a one-piece integral hub for allowing the connector head 60A extending into the functional hub 217A from the interior cavity 2162A of the hub body 216A.

Moreover, the speaker unit 51A preferably comprises a plurality of speakers radially supported within the speaker compartment 214A of the awning frame 20A for creating a stereo surround sound effect when the audio signal is transmitted to the speaker unit 51A.

Figure 14:
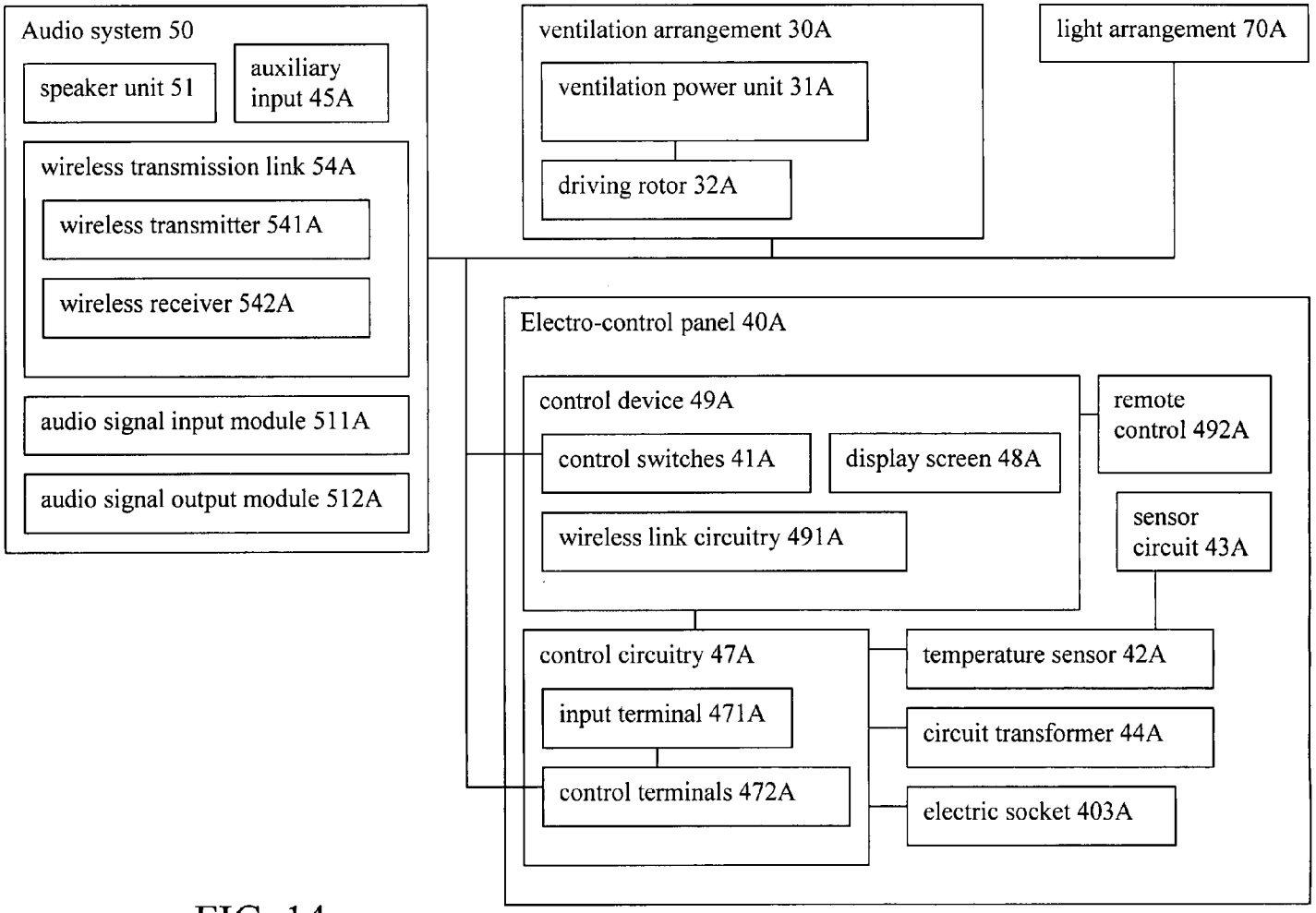
FIG. 14 is a block diagram of the outdoor umbrella according to the above second preferred embodiment of the present invention, illustrating the electro-control panel electrically connecting to each of the electrical appliances.

In order to enhance the sound quality delivered by the audio system, the functional umbrella hub 21A further has a resonance chamber 2141A formed at the speaker compartment 214A, wherein the speaker unit 51A further comprises a subwoofer speaker 511A supported at the resonance chamber 2141A for generating special sound quality of the audio sound output from the speaker unit 51A, as shown in FIG. 14 of the drawings.

The functional umbrella hub 21A further comprises a hub body 216A having a plurality of hinges 2161A for respectively coupling with the awning arms 22A in a radially extending manner preferably via the awning supporting arms 25A, and an interior cavity 2162A for the connector head 60A disposing therein.

In the second preferred embodiment of the present invention, the light arrangement 70A may further provided as another add-on electrical appliance of the outdoor umbrella, wherein the light arrangement 70A is preferably provided at a bottom side of the functional hub 217A for electrically connecting with the connector head 60A so as to generate a light illumination as another additional function for the outdoor umbrella. More specifically, the light arrangement 70A comprises a ring-shaped light housing 71A, having a connector inlet 711A for electrically connecting to the connector head 60A, mounted to the bottom side of the functional hub 217A, and a plurality of illumination elements 72A spacedly and coaxially mounted at the light housing 71A for illuminating an area under the awning arms 22A, i.e. the shading area. Note that the illumination elements 72A are a plurality of LEDs electrically and spacedly mounted at the light housing 71A.

The functional umbrella hub 21A further comprises a mounting unit 218A for detachably mounting the functional hub 217A under the hub body 216A, wherein the mounting unit 218A comprises a retaining panel 2181A integrally formed at the bottom side of the hub body 216A, and at least a fastening element 2182A detachably fastening the functional hub 217A at the retaining panel 2181A to detachably mount the functional hub 217A to the hub body 216A.

The light arrangement 70A may also comprise a ring-shaped light tube 73A mounted at the light housing 71A for illuminating an area under the awning arms 22A. Thus, the light tube is capable of providing uniform line of light source for the shading area.

Accordingly, the electro-control panel 40A is preferably provided at the awning frame 20A for minimizing a distance between the control panel 40A and each of the electrical appliances, so as to simplify a wire connecting arrangement for electrically connecting the electro-control panel 40A and the electrical appliances. More specifically, each of the ventilation arrangement 30A, the audio system 50A, and the light arrangement 70A of the electrical appliances is electrically connected to the control panel 40A for being electrically and adjustably controlled therethrough via a connecting wire 401A of the wire connecting arrangement.

Figure 11:
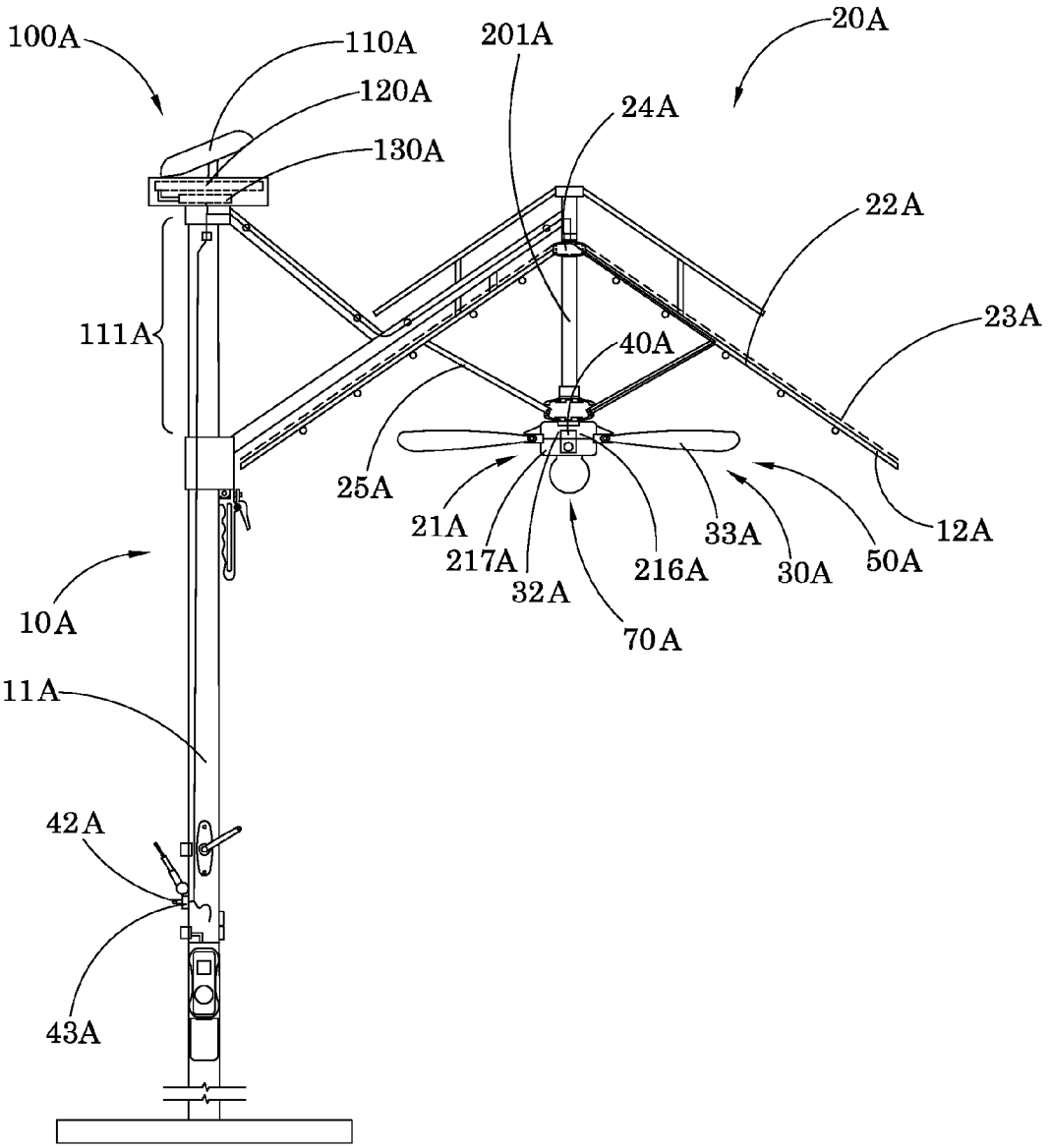
FIG. 11 is a perspective view of an outdoor umbrella according to a second preferred embodiment of the present invention.

As shown in FIG. 11 of the drawings, the awning frame 20A further comprises a central awning arm 201A downwardly extended from the upper housing 24A to the functional umbrella hub 21A for stably interrelate the functional umbrella hub 21A, the awning arms 22A, and the awning supporting members 25A, so as to firmly position the functional umbrella hub 21A to prevent the unwanted movement and to stably extend the awning 23A at the unfolded position.

Figure 13:
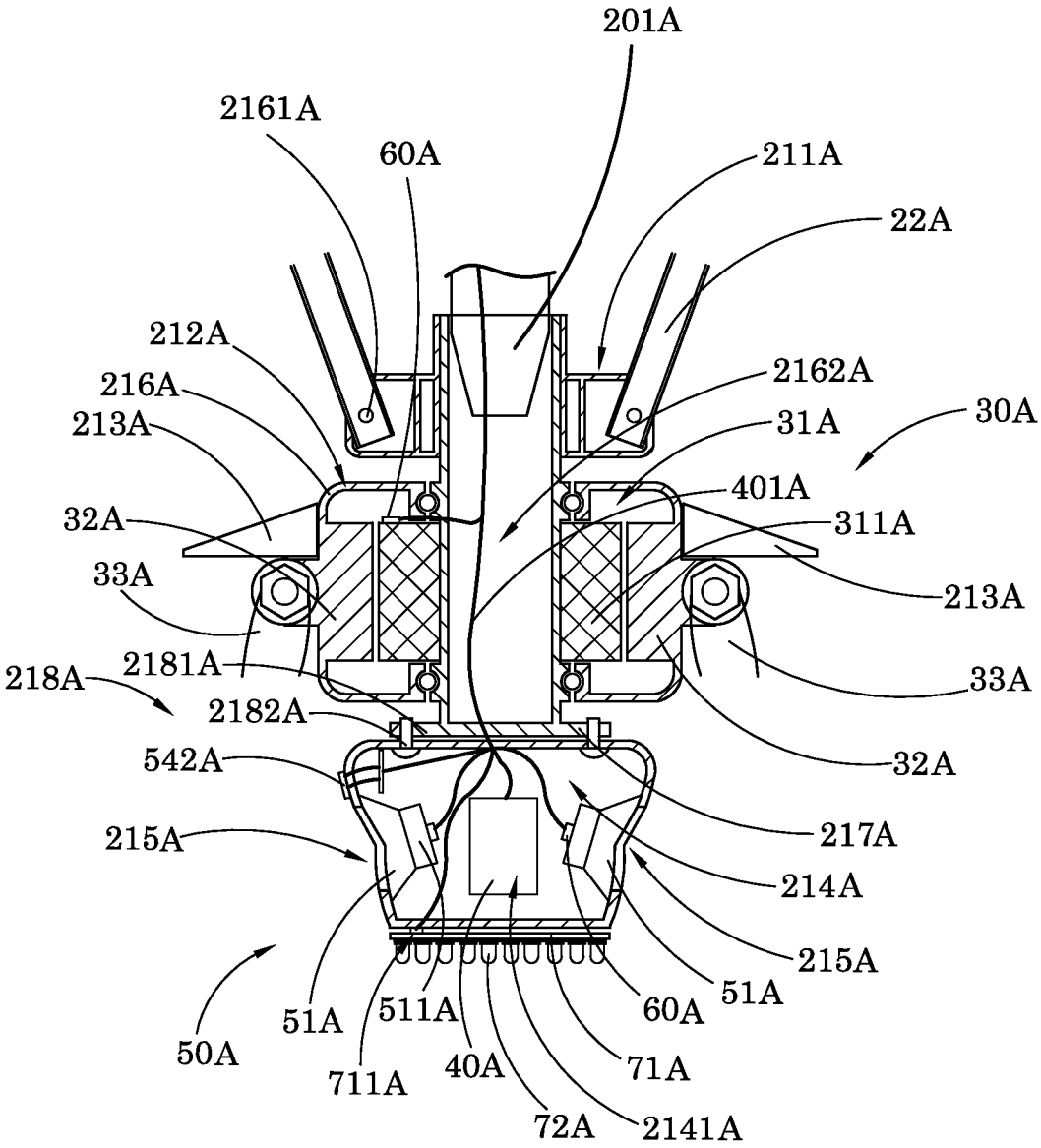
FIG. 13 is a sectional side view of the functional umbrella hub according to the above second preferred embodiment of the present invention.

Accordingly, the electro-control panel 40A is supported by the awning frame 20A within the shading area for selectively controlling each of the electrical appliances. As shown in FIGS. 11 to 13, the electro-control panel 40A is preferably built-in with the functional umbrella hub 21A of the awning frame 20A to electrically link with the electrical appliances for minimizing an electrical connection between the electro-control panel 40A and the electrical appliances.

In particularly, the electro-control panel 40A is built-in with the functional hub 217A to electrically link with the electrical appliances. Therefore, the distances between the electro-control panel 40A and the electrical appliances is minimized, so that the layout or the wire connecting arrangement of the connecting wires 401 for electrically linking the electrical appliances to the electro-control panel 40A is simplified. The electro-control panel 40A provided underneath the awning 23A, thus, is substantially being protected thereby.

It is worth to mention that there is no need for pre-wiring the connecting wires 401A to electrically link the electro-control panel 40A to electrical appliances through the supporting frame 10A, so as to minimize the manufacturing cost. As a result, the electro-control panel 40A is physically protected by the awning 23A, so as to maintain the maximum lift span and optimal aesthetic appearance of the present invention.

In order to adjustably control an operation of the ventilation arrangement 30A, the audio system 50A, the light arrangement 70A, or any other electrical appliances of the outdoor umbrella, the electro-control panel 40A is also adapted for adjustably and electrically controlling the electrical appliances. Accordingly, the electro-control panel 40A comprises a control device 49A comprising one or more control switches 41A electrically connected to each of the electrical appliances, so as to control each of the electrical appliances in an on-and-off manner. As embodied in the preferred embodiment, three of the switches 41A are provided to electrically link to the ventilation arrangement 30A, the audio system 50A, and the light arrangement 70A.

Accordingly, the control panel 40A further comprises a control circuitry 47A operatively connecting to the control device 49A and each of the electrical appliances to selectively operate the ventilation arrangement 30A, the audio system 50A, and the light arrangement 70A. The control device 49A further comprises a display screen 48A electrically connected to the control circuitry 47A for displaying an operation status thereof. As a result, the user is able to conveniently monitor the operation of the electrical appliance in a single display device, i.e. the display screen 48A.

More specifically, the control circuitry 47A further comprises an input terminal 471A adapted for electrically connecting to a power source, and a plurality of control terminals 472A for selectively connecting to the electrical appliances respectively.

The control switches 41A of the control device 49A may further has a plurality of adjusting functions for adjustably controlling variety of performance modules of the electrical appliances, such as the rotational speed of the rotor 32A to control the airflow under the shielding area; the volume of the audio system 50A; and a light intensity of the light arrangement 70A.

The control device 49A may further comprises a wireless link circuitry 491A integrally formed within the control panel 40A and a remote control 492A pairing with the wireless link circuitry 491A of the control device 49A, such that the remote control 492A enables a user to wirelessly control the electrical appliances via the remote control 492A.

The control panel 40A further comprises a temperature sensor 42A supported by the supporting frame 10A for detecting an ambient temperature and a sensor circuit 43A which is electrically communicating with the temperature sensor 42A and is arranged in such a manner that when the ambient temperature is higher than a user-preset temperature, the sensor circuit 43A automatically activates the ventilation power unit 31A to drive the driving rotor 32A to rotate to create the airflow in the shading area. In other words, the ventilation arrangement 30A can either be activated manually through the control panel 40A, or by ambient temperature rising above a predetermined threshold. In the latter case, the ventilation arrangement 30A is activated automatically by the sensor circuit 43A.

Furthermore, the control panel 40A further comprises a circuit transformer 44A electrically connecting with the ventilation arrangement 30A for transforming an AC power from an external power source to a DC power for the ventilation power unit 31A. Thus, the ventilation arrangement 30A is adapted for being powered up by an external power source for prolonged use of the ventilation system. Alternatively, the ventilation arrangement 30A can also be powered by rechargeable batteries for shorter usage duration.

As a further alternative, the outdoor umbrella can further comprise a solar energy power system 100A which comprises a solar energy collection board 110A and a solar energy conversion circuit 120A mounted on the supporting frame 10A. The solar energy collection board 110A is adapted to collect solar energy from sunlight, wherein the sunlight will be transformed to electric energy by the solar energy conversion circuit 120A for providing adequate power to operate the electrical appliances installed on the outdoor umbrella. The transformed energy is to be stored by a rechargeable battery 130A electrically connected with the solar energy conversion circuit 120A.

As mentioned above, the audio signal input module 511A may integrally provided at the control panel 40A, wherein an auxiliary input 45A is preferably further provided at the control panel 40A as the audio signal input module 511A, so as to communicatively connect to a portable music player to receive the audio signal therefrom. Therefore, the audio signal from the portable music player or the like is able to transmit the audio signal thereof from the auxiliary input 45A of the audio signal input module 511A to the audio signal output module 512A, so as to generate the sound effect from the speaker unit 51A in responsive to the audio signal.

It is worth to mention that the audio system 50A of the present invention is adapted to play music originated from a wide variety of conventional portable music players, such as CD players, DVD players, MP3 and the like for providing the maximum number of audio options for the user of the present invention.

In order to further enhance the source by which audio sound signal can be acquired, the control panel 40A further comprises a radio broadcasting circuit 46A as the audio signal input module 511A for receiving radio wave as the audio signal, such that the control panel 40A transmits the audio signal to the speaker unit 51A for radio broadcasting. As such, the audio system 50A is also capable of processing radio signal for delivering radio sound signal as the audio signal as mentioned above.

Alternatively, the audio system 50A further comprises a wireless transmission link 54A for wirelessly transmitting the audio signal from the control panel 40A to the speaker unit 51A, wherein the wireless transmission link 54A comprises a wireless transmitter 541A integrated with the control panel 40A and a wireless receiver 542A which is integrated with the speaker unit 51A and is wirelessly communicating with the wireless transmitter 541A to wirelessly transmit the audio signal from the control panel 40A to the speaker unit 51A. In this situation, the connecting wire 401A electrically linking the control panel 40A and the audio system 50A of the electrical appliance may not be necessary or is relatively short, yet it can still be used in conjunction with the wireless transmission link 54A to cater for different needs.

Moreover, the electro-control panel 40A further comprises a panel housing 402A built-in with the functional umbrella hub 21A that the panel housing 402A is provided at a peripheral wall of the functional umbrella hub 21A to protectively receive the control circuitry 47A in the panel housing 402A. Thus, the user is able to control the electrical appliances by simply operating the control panel 40A at the panel housing 402A.

The electro-control panel 40A further comprises an electric socket 403A which is provided on the awning frame 20A and is electrically connected to the input terminal 471A for electrically connecting to a power source, such as an AC power source. It is appreciated that the electric socket 403A may be individually provided at the supporting frame adjacent to a bottom portion of the supporting frame 10A and electrically connected to the input terminal 471A of the control panel for supplying the power source, so as to conveniently connect to an external power source.

Accordingly, the circuit transformer 44A electrically connects the electric socket 403A with the input terminal 471A of the control circuitry 47A for transforming an AC power from the external AC power source to a DC power so as to supply a predetermined amount of electricity to the electric appliances.

Figure 15A:
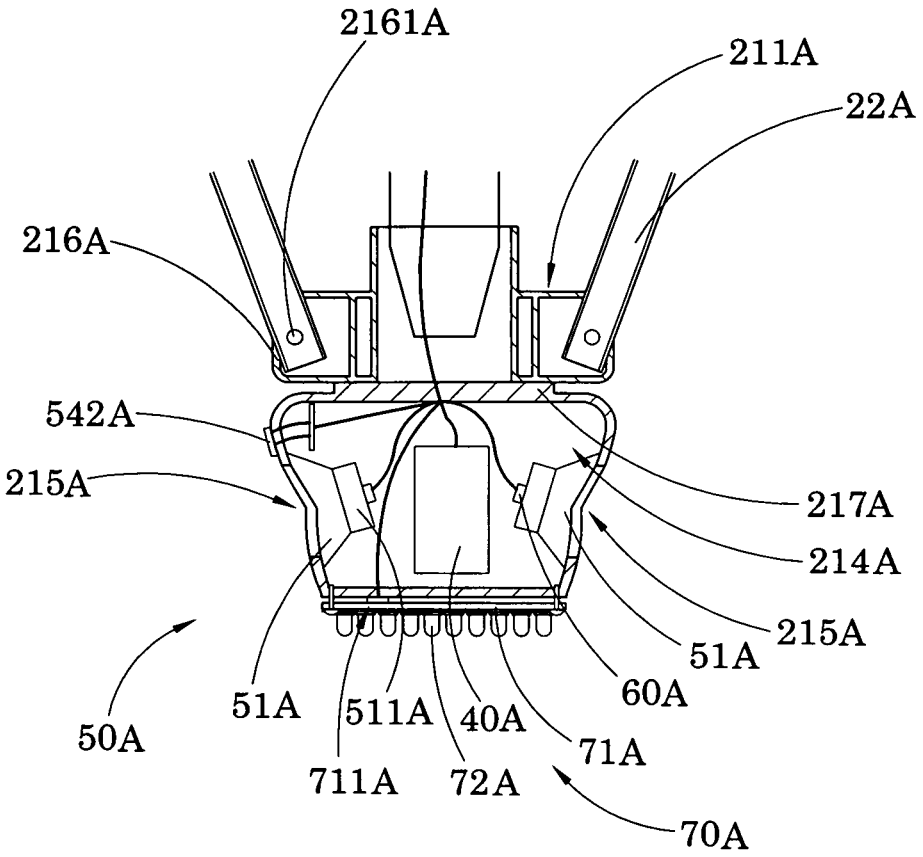
FIGS. 15A to 15C are schematic diagrams of different combinations of electrical appliances incorporating with alternative functional umbrella hub according to the above embodiment preferred embodiment of the present invention.
Figure 15B:
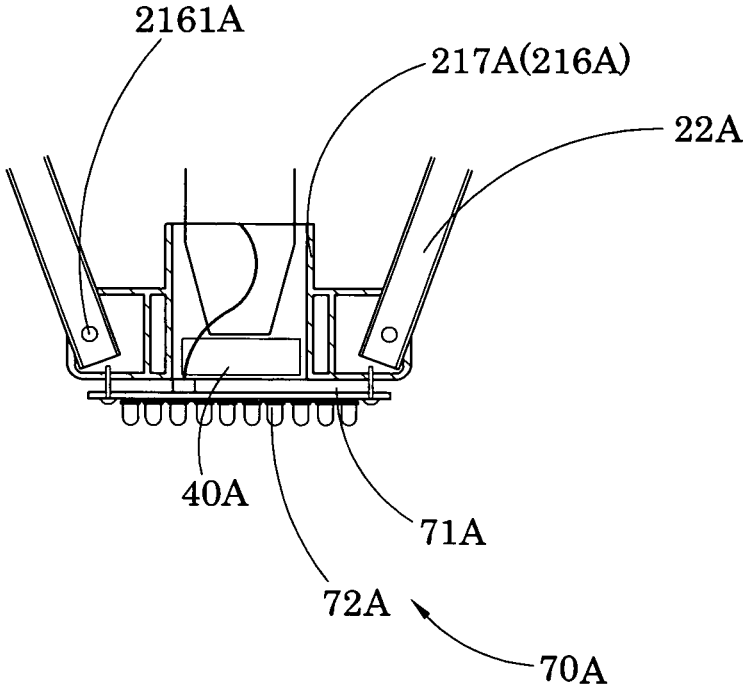
Figure 15C:
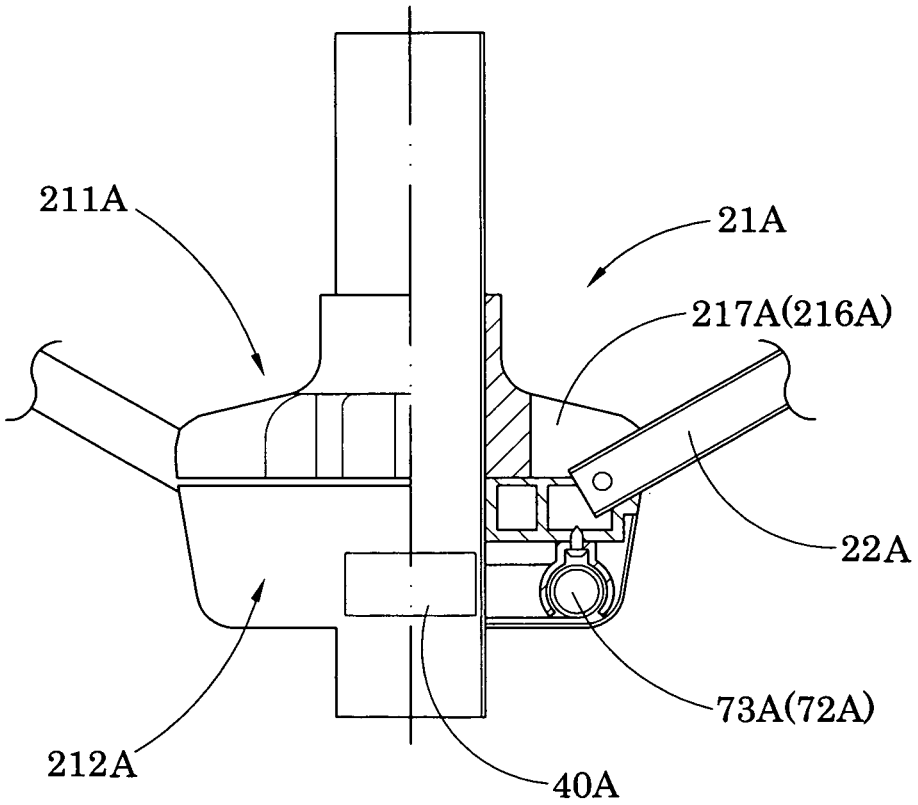

It is worth mentioning that the outdoor umbrella may form different embodiments with different combinations of electrical appliances. Referring to FIG. 15A of the drawings, the outdoor umbrella comprises the audio system 50A, the light arrangement 70A, but not the ventilation arrangement, wherein the audio system 50A and the light arrangement 70A are supported by the functional hub 217A of functional umbrella hub 21A. In addition, the functional hub 217A is downwardly and integrally extended from the hub body 216A, wherein the electro-control panel 40A is supported at the function hub 217A to control the audio system 50A and the light arrangement 70A. Referring to FIG. 15B of the drawings, only the light arrangement 70A has been installed, wherein the functional hub 217A is integrally formed with the hub body 216A. The electro-control panel 40A is supported at the function hub 217A to control the light arrangement 70A. FIG. 15C of the drawings, one may appreciate that the illumination elements 72A are embodied as the ring-shape light tube 73A, wherein the functional hub 217A is integrally formed with the hub body 216A. The electro-control panel 40A is supported at the function hub 217A to control the ring-shape light tube 73A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor umbrella, comprising:

an umbrella frame comprising a supporting frame and an awning frame, wherein said supporting frame comprises a hollow supporting shaft, wherein said awning frame comprises a functional umbrella hub suspendedly supported alongside said supporting shaft of said supporting frame, an upper housing suspendedly supported by said supporting shaft of said supporting frame at a position above said functional umbrella hub, a plurality of awning arms radially and outwardly extended from said upper housing, a plurality of awning supporting arms radially and outwardly extended from said functional umbrella hub to pivotally couple said awning arms respectively, and an awning supported by said awning arms to define a shading area under said awning, wherein said awning frame further comprises a central awning arm downwardly extended from said upper housing to said functional umbrella hub and extended alongside said supporting shaft for stably interrelating said functional umbrella hub, and said awning arms, so as to firmly position said functional umbrella hub to prevent unwanted movement and to stably extend said awning at an unfolded position, wherein said functional umbrella hub comprises a hub body coupling with said central awning arm, and a functional hub integrally and downwardly extended from said hub body to form a one-piece integral hub, wherein said awning supporting arms are pivotally coupled with said hub body;

one or more electrical appliances being supported by said functional umbrella hub;

a battery supported at a top end of said supporting shaft and electrically linked to said electrical appliances via a connecting wire, wherein said connecting wire is extended through interiors of one of said awning arms and one of said awning supporting arms in order to link said battery to said electrical appliances; and an electro-control panel which is supported by said awning frame within said shading area for selectively controlling each of said electrical appliances, wherein said electro-control panel is built-in with said functional hub of said functional umbrella hub of said awning frame to electrically link with said electrical appliances for minimizing an electrical connection between said electro-control panel and said electrical appliances, wherein said electro-control panel is slid corresponding to a sliding movement of said functional umbrella hub, wherein said functional hub is arranged to house at least one of said electrical appliances in said functional hub, wherein said connecting wire is extended from said battery to electrically link to said electro-control panel, extended within an interior of said central awning arm, and extended through said hub body to electrically connect with said electrical appliances at said functional hub.

2. The outdoor umbrella, as recited in claim 1, wherein a connector head is provided at a position within said functional umbrella hub for electrically connecting said electro-control panel with each of said electrical appliances respectively, wherein said hub body defines an interior cavity, and said connector head extends into said functional hub from said interior cavity of said hub body.

3. The outdoor umbrella, as recited in claim 2, wherein said electrical appliances are at least two of an audio system, a light arrangement and a ventilation arrangement including a plurality of fan blades, wherein said fan blades, which are made of soft fabric, are radially and outwardly extended from said functional hub below said hub body.

4. The outdoor umbrella, as recited in claim 3, further comprising a solar energy collection board supported at said top end of said supporting shaft and electrically connected to said battery.

5. The outdoor umbrella, as recited in claim 4, wherein said electro-control panel comprises a control circuitry having an input terminal electrically connecting to said battery, a plurality of control terminals selectively connecting to said electrical appliances respectively, a control device electrically connecting to said control circuitry to selectively control said electrical appliances, and a display screen electrically linked to said control circuitry for displaying an operation of each of said electrical appliances.

6. The outdoor umbrella, as recited in claim 5, wherein said electro-control panel further comprises a panel housing built-in with said functional umbrella hub that said panel housing is provided at a peripheral wall of said functional umbrella hub to protectively receive said control circuitry in said panel housing, and a plurality of control switches which are provided on said panel housing and are electrically connected to said control terminals to selectively control said corresponding electrical appliances.

7. The outdoor umbrella, as recited in claim 6, wherein said electro-control panel further comprises an integrated radio broadcasting circuit and an auxiliary input for wirelessly and communicatively connecting to a portable music player, such that said control circuitry provides an added audio function for incorporating with said electrical appliances.

8. The outdoor umbrella, as recited in claim 7, wherein said electro-control panel further comprises a wireless link circuitry integrated with said control circuitry and a remote control wirelessly communicating to said wireless link circuitry to control said control circuitry for remotely controlling said electrical appliances in a wireless manner.

* * * * *